US006209813B1

(12) United States Patent
Lima et al.

(10) Patent No.: US 6,209,813 B1
(45) **Date of Patent: *Apr. 3, 2001**

(54) GRINDING APPARATUS FOR FOODSTUFFS

(75) Inventors: Paul G. Lima, Ft. Worth; John Mark Singleton, Trophy Club, both of TX (US)

(73) Assignee: A. C. Horn & Co., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/296,443

(22) Filed: Apr. 21, 1999

Related U.S. Application Data

(63) Continuation of application No. 09/034,123, filed on Mar. 3, 1998, now Pat. No. 5,927,628.

(51) Int. Cl.[7] ..... B02C 7/14

(52) U.S. Cl. ..... 241/259.1; 241/261.2; 241/285.3

(58) Field of Search ..... 241/261.2, 261.3, 241/37, 385.3, 259.1, 259.2

(56) References Cited

U.S. PATENT DOCUMENTS 5,927,628 * 7/1999 Lima et al. ..... 241/259.1

* cited by examiner

*Primary Examiner*—Mark Rosenbaum
(74) *Attorney, Agent, or Firm*—Michael A. O'Neil

(57) ABSTRACT

An apparatus for grinding foodstuffs includes a grinding chamber comprising a housing having fixed and driven grinding members positioned therein. The driven grinding member is mounted at one end of a drive shaft, and apparatus is provided at the opposite end of the drive shaft for positioning the drive shaft longitudinally and thereby positioning the driven grinding member relative to the fixed grinding member. The housing supports the driven grinding member and is mounted for pivotal movement about horizontal and vertical axes to vary the parallelism of the fixed grinding member relative to the driven grinding member.

12 Claims, 17 Drawing Sheets

GRINDING APPARATUS FOR FOODSTUFFS

CROSS REFERENCE TO RELATING APPLICATION

This application is a continuation of prior application Ser. No. 09/034,123 filed Mar. 3, 1998, now U.S. Pat. No. 5,927,628 issued Jul. 27, 1999.

TECHNICAL FIELD

This invention relates generally to apparatus for grinding foodstuffs such as grains, nuts, and the like, and more particularly to an improved mechanism for establishing and maintaining precise alignment between relatively moving grinding members.

BACKGROUND AND SUMMARY OF THE INVENTION

Throughout human history foodstuffs such as grains, nuts, and the like have been ground into meal and flour by means of grinding stones. Typically, the material to be ground is placed between a set of grinding stones which are then moved, i.e., rotated, with respect to each other to effect grinding. Traditionally, grinding stones were rotated by means of wind, water, or animal power.

More recently, electric and hydraulic motors have replaced the traditional power sources. Also, at least in some cases, metal plates having very high hardness have replaced stones for use in grinding foodstuffs. Notwithstanding these and other advances, problems in establishing and maintaining precise alignment between relatively moving grinding members continue to characterize most grinding apparatus.

Traditional systems for establishing and maintaining relative positioning between grinding members have been trial and error in nature. Typically, the grinding members are initially positioned relative to one another, after which the spacing and alignment between the grinding members is checked using feeler gauges, etc. At this point shims are employed to correct deficiencies in positioning and alignment of the grinding members, after which the feeler gauges are again employed to check the results. This procedure is continued until the best possible precision in the spacing and alignment is achieved.

Unfortunately, the initial alignment of the grinding members, achieved through painstaking trial and error procedures, does not assure proper alignment of the grinding members after grinding operations commence. The introduction of material to be ground into the space between the grinding members imposes significant forces on the grinding members tending to distort the alignment therebetween, both as to spacing and as to parallelism. In such event, further trial and error procedures are necessary in order to achieve alignment of the grinding members during the grinding process. It will therefore be understood that substantial improvements in the art are indicated in order to simplify the process for achieving alignment of the grinding members of a grinding apparatus and for assuring continuing alignment of the grinding members during grinding operations.

The present invention comprises a grinding apparatus for foodstuffs which fulfills the foregoing and other requirements long since found lacking in the prior art. In accordance with the broader aspects of the invention, a driven grinding member is positioned at one end of a shaft which is rotatably supported in spaced apart bearings. A sprocket is positioned between the bearings for actuation to rotate the driven grinding member about the axis of the shaft. Apparatus is provided at the opposite end of the shaft for positioning the driven grinding member in accordance with the requirements of particular grinding operations.

The driven grinding member is positioned within a grinding chamber in a precisely spaced apart relationship to a fixed grinding member. The fixed grinding member is rigidly secured to a door which is in turn rigidly securable to the grinding chamber housing. Structure is provided for pivoting the fixed grinding member about vertical and horizontal axes in order to assure precise parallelism between the driven and fixed grinding members.

The door also supports an input mechanism for delivering foodstuffs to be ground into the space between the driven and fixed grinding members. The input mechanism includes a hopper for receiving foodstuffs to be ground and an auger for transferring the foodstuffs from the hopper through the fixed grinding member and into the space between the fixed grinding member and the driven grinding member. The driven grinding member is provided with a distributing blade which causes foodstuffs received from the auger to move outwardly thereby eliminating the necessity of providing a foodstuff delivery auger having sufficient power to force the foodstuffs outwardly between the fixed and driven grinding members. Grinding chamber clearing members are mounted on the driven grinding member for rotation therewith.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
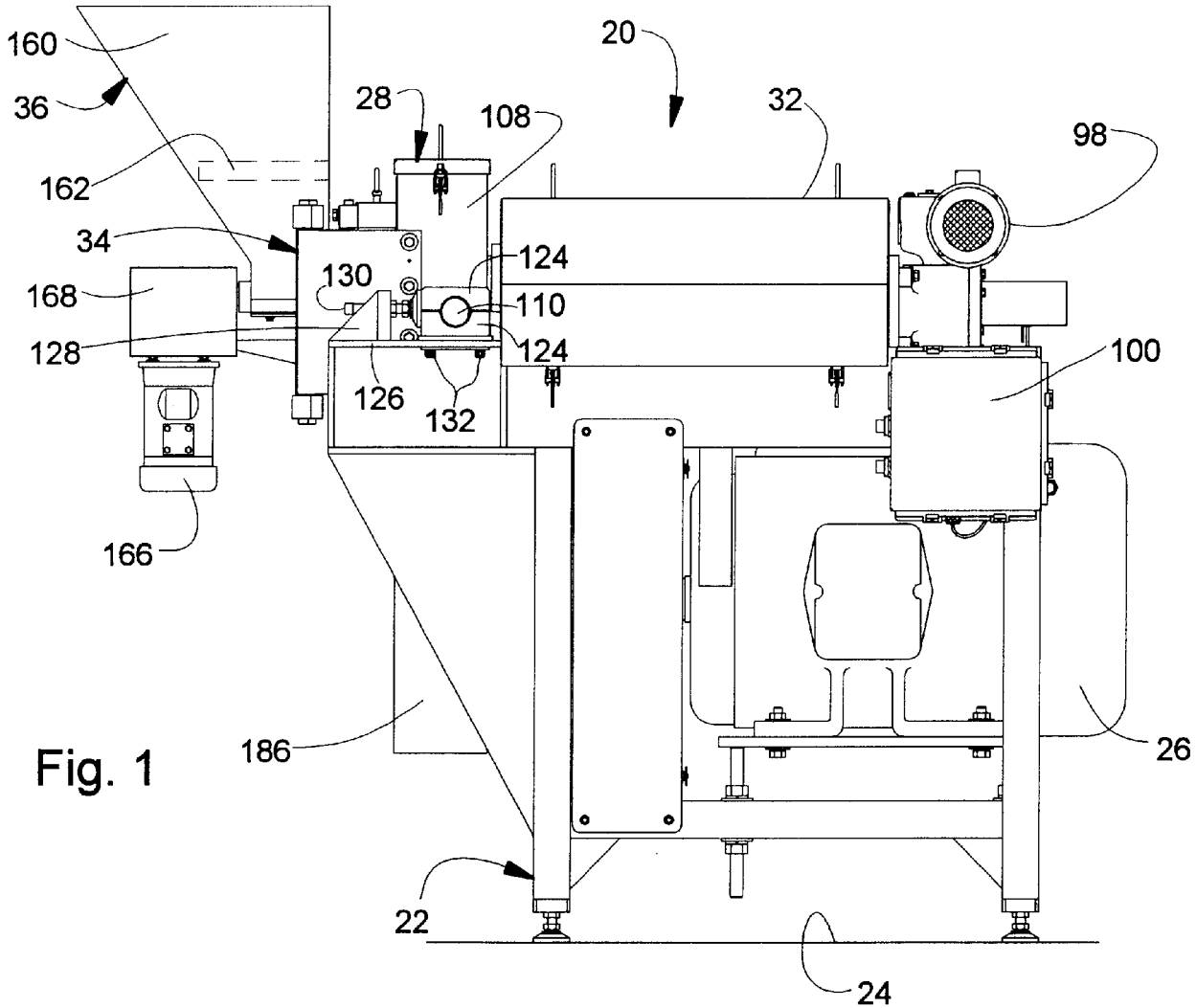
FIG. 1 is a side view of a grinding apparatus for foodstuffs incorporating the preferred embodiment of the invention.
Figure 2:
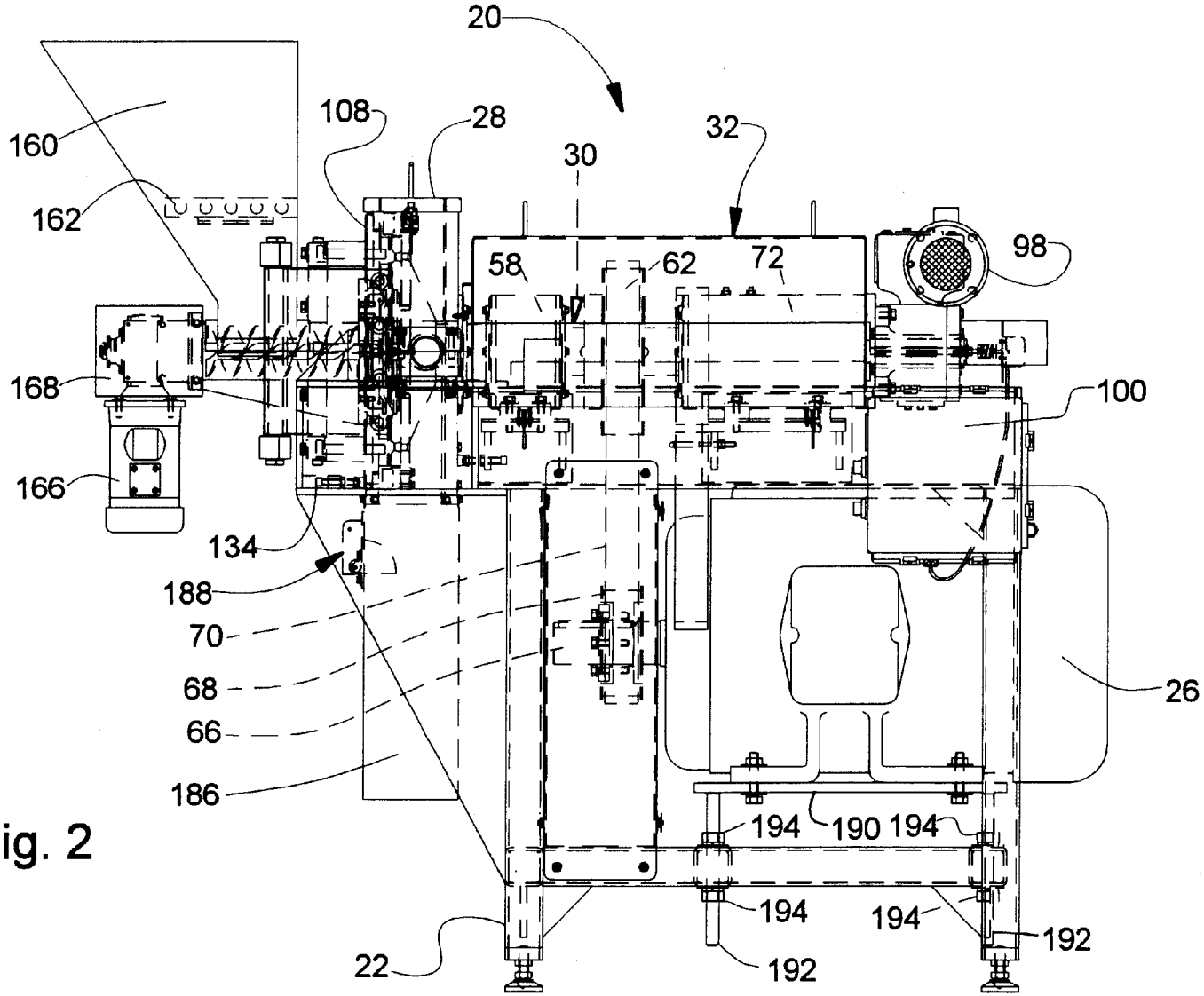
FIG. 2 is an illustration similar to FIG. 1 showing the apparatus of FIG. 1 in greater detail.

Referring now to the Drawings, and particularly to FIGS. 1 and 2 thereof, there is shown a grinding apparatus for foodstuffs 20 comprising the preferred embodiment of the invention. The apparatus 20 includes a rigid frame 22 adapted to support the apparatus 20 on an underlying surface 24. A motor 26 is supported on the frame 22 and provides operating power for the grinding mechanism of the apparatus 20.

The grinding apparatus 20 includes a grinding chamber 28 which encloses a driven grinding member and a fixed driving member (not shown in FIGS. 1 and 2). The driven grinding member is mounted at one end of a drive shaft 30 located within a housing 32 for actuation by the motor 26 to effect rotation of the driven grinding member relative to the fixed grinding member. The fixed grinding member is rigidly mounted on a door 34. During grinding operations foodstuffs to be ground are directed into the space between the driven grinding member and the fixed grinding member by an input mechanism 36 also supported on the door 34.

Figure 3:
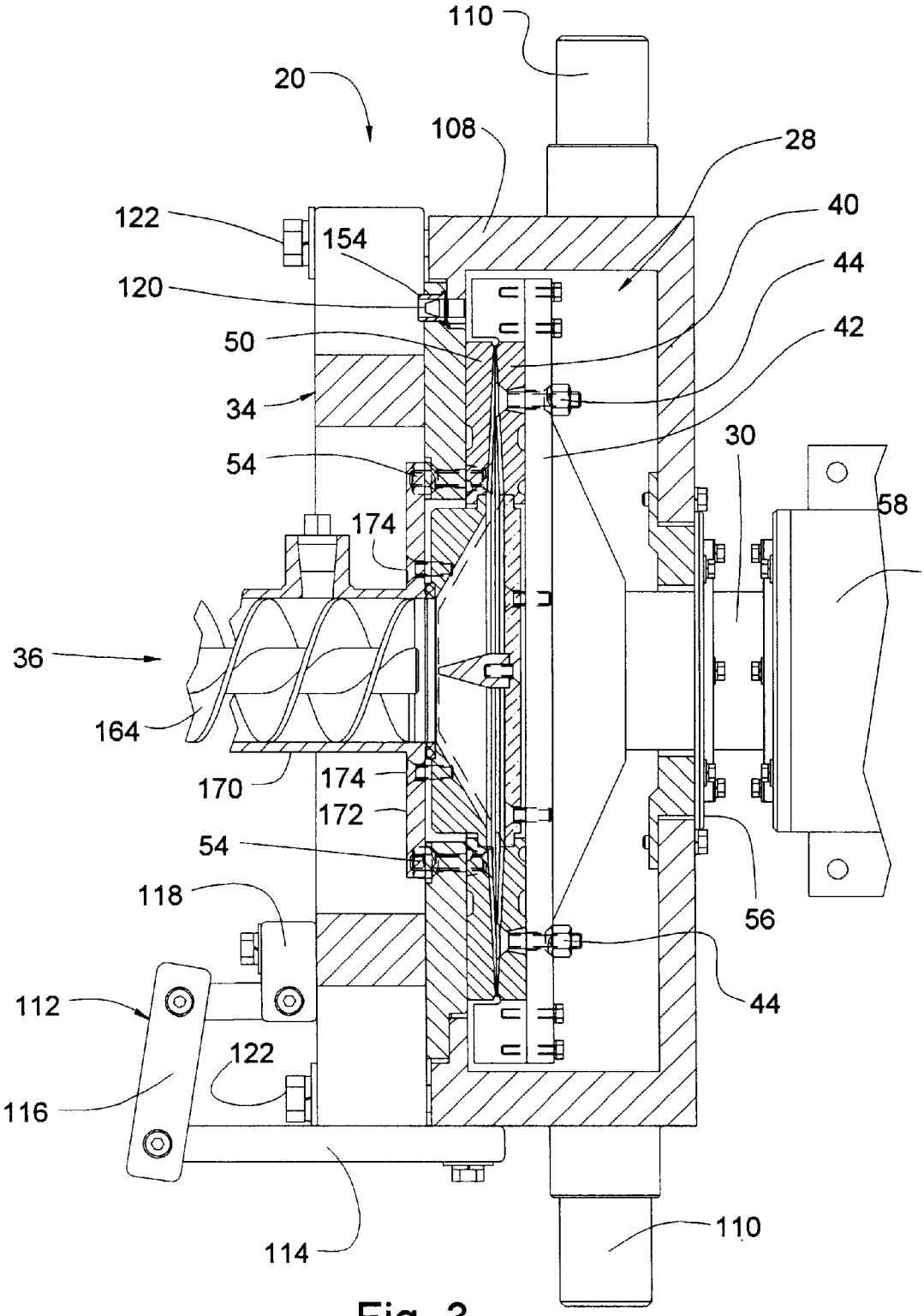
FIG. 3 is a longitudinal sectional view taken through the grinding chamber of the apparatus of FIG. 1.
Figure 4:
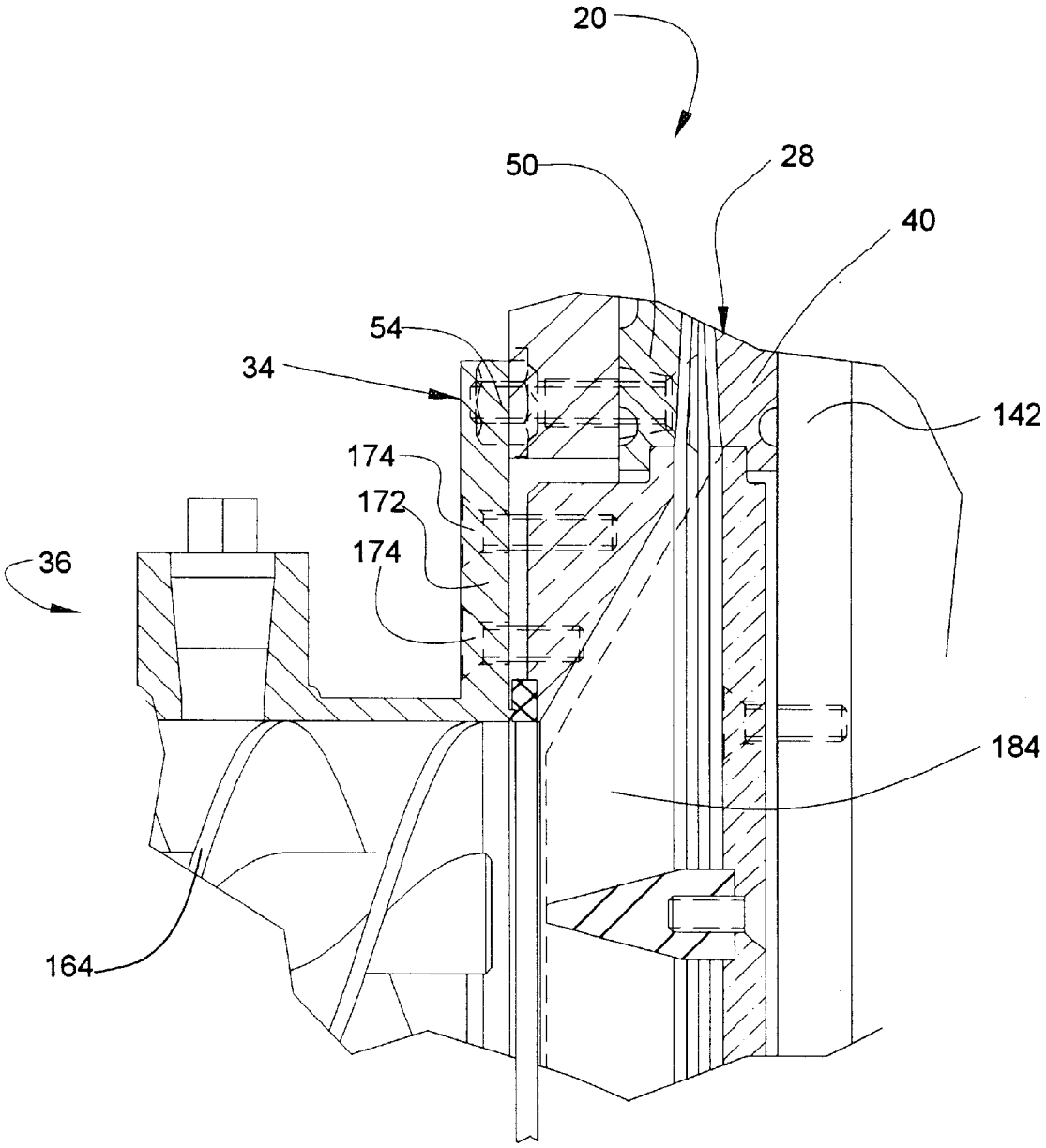
FIG. 4 is an enlargement of a portion of FIG. 3.

As is best shown in FIGS. 3 and 4, the grinding apparatus for foodstuffs 20 includes a driven grinding member 40 which is secured to a driven grinding member support plate 42 by a plurality of fasteners 44. The material used in the construction of the driven grinding member 40 will depend upon the requirements of particular applications of the invention. Thus, some grinding operations utilizing the apparatus 20 may require a driven grinding member made from stone. Other grinding operations are preferably carried out using a driven grinding member 40 formed from a metal having a Rockwell C hardness of 56or greater.

A fixed grinding member 50 is located within the grinding chamber 28 for cooperation with the driven grinding member 40 to effect grinding operations. Like the driven grinding member 40, the fixed grinding member 50 may be fabricated from stone or metal depending on the requirements of particular applications of the invention. The fixed grinding member is rigidly secured to the door 34 by a plurality of fasteners 54.

Figure 5:
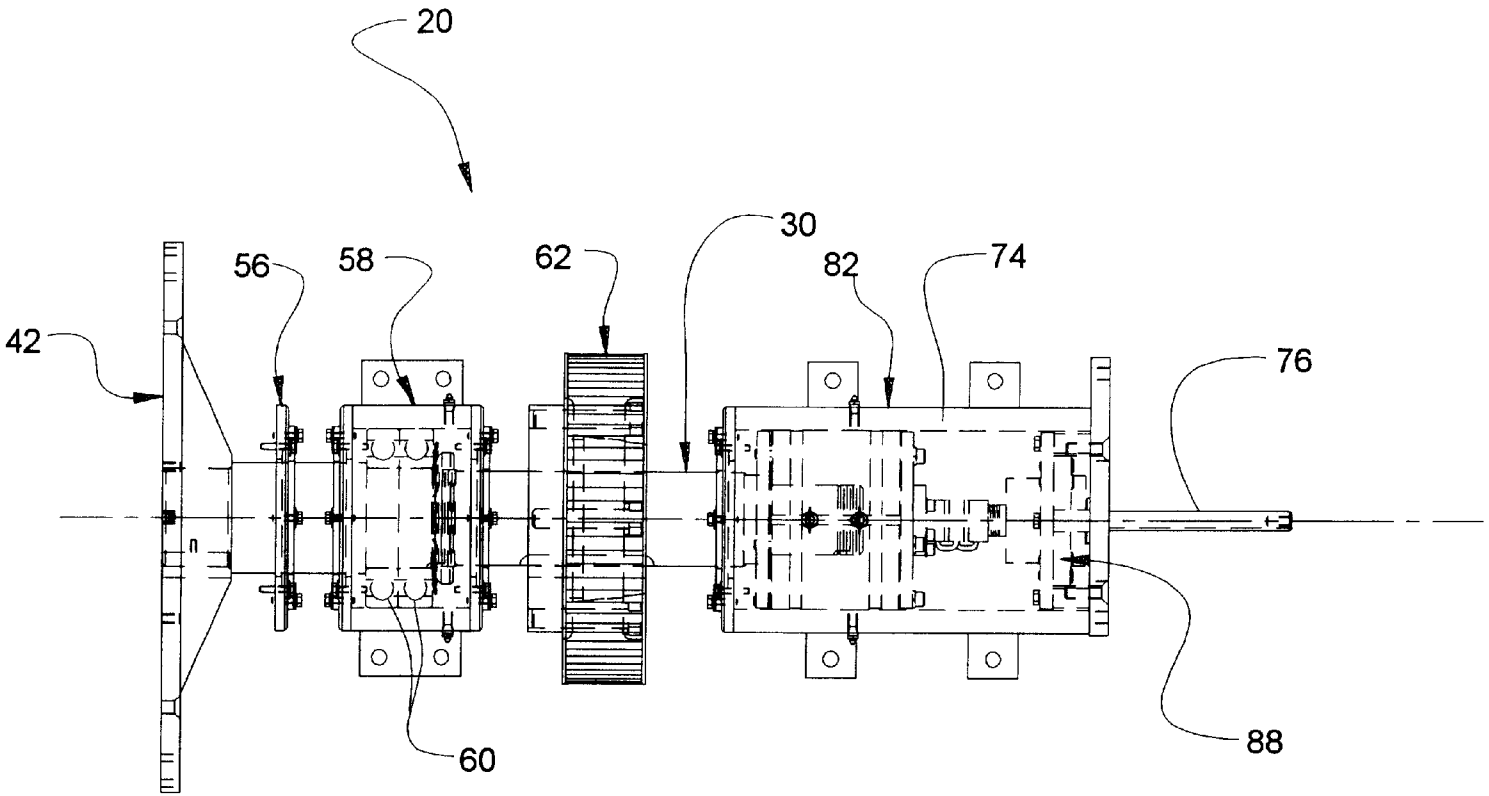
Fig. 5 PRIOR ART
FIG. 5 is a detailed illustration of the drive shaft assembly of the apparatus of FIG. 1.

The drive shaft 30 of the apparatus for grinding foodstuffs 20 is shown in greater detail in FIG. 5. The driven grinding member (not shown in FIG. 5) is mounted on the support plate 42 which is mounted at one end of the drive shaft 30. A sealing plate 56 is positioned adjacent to the support plate 42 and is utilized to seal the point of entry of the drive shaft 30 into the grinding chamber 28. A bearing housing 58 is located adjacent the sealing plate 56 and encloses bearings 60 which rotatably support the drive shaft 30. The bearings 60 preferably comprise ball bearings, however, other types of bearings may be utilized in the practice of the invention, if desired.

Figure 17:
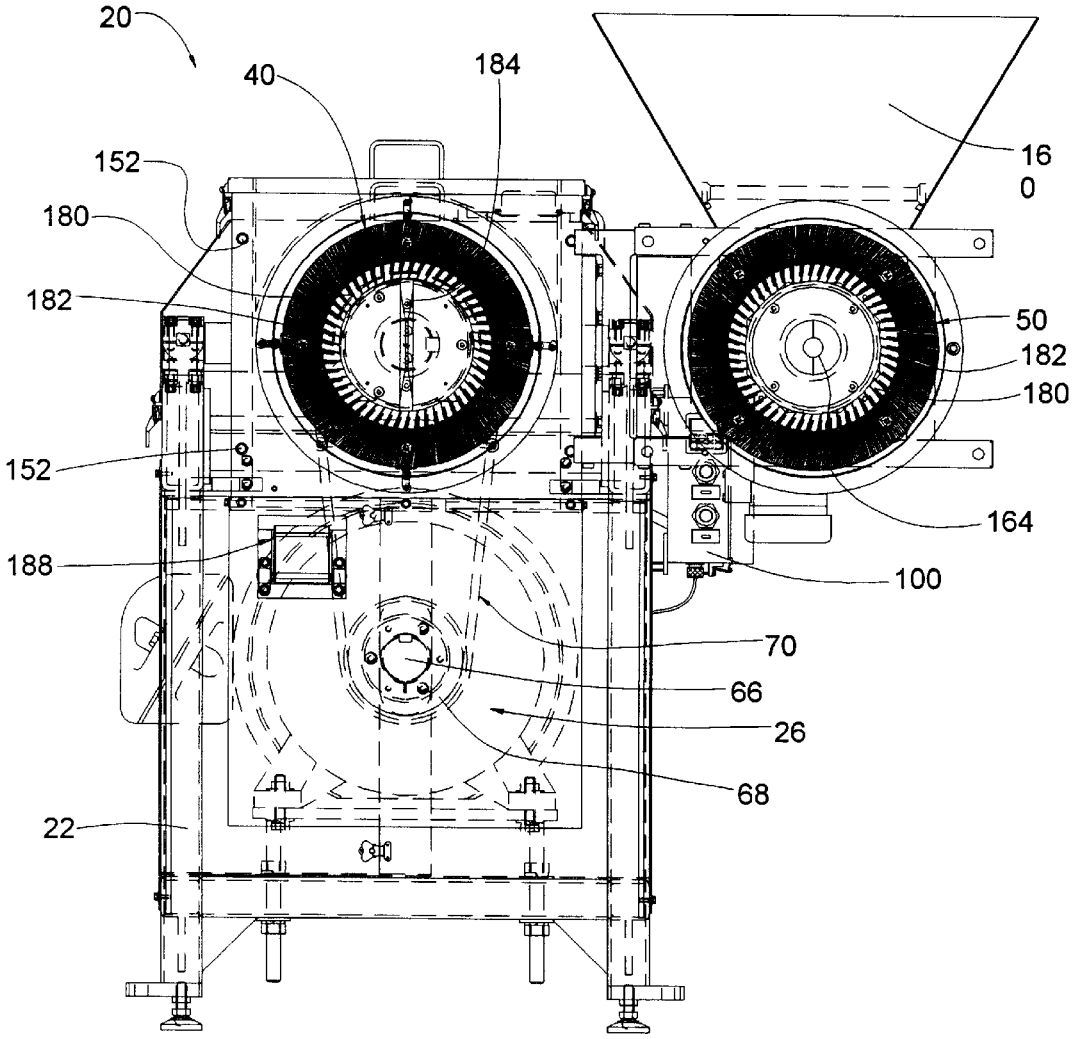
FIG. 17 is an illustration similar to FIG. 11 showing the apparatus of FIG. 1 with the door thereof in the open position.

A driven pulley 62 is secured to the drive shaft 30 adjacent the bearing housing 58. Referring momentarily to FIGS. 2 and 17, the motor 26 has an output shaft 66. A drive pulley 68 is secured to the output shaft 66 for rotation thereby under the action of the motor 26. A toothed belt 70 is secured around the drive pulley 68 and the driven pulley 62. Therefore, upon actuation of the motor 26, the drive shaft 30 is rotated under the action of the output shaft 66, the drive pulley 68, the toothed belt 70, and the driven pulley 62.

Referring again to FIG. 5, a driven grinding member positioning mechanism 72 is located at the opposite end of the drive shaft 30 from the driven grinding member support plate 42. The driven grinding member positioning apparatus 72 includes a housing 74. The drive shaft 30 extends from one end of the housing 74 and a positioning input shaft 76 extends from the opposite end of the housing 74.

Figure 6:
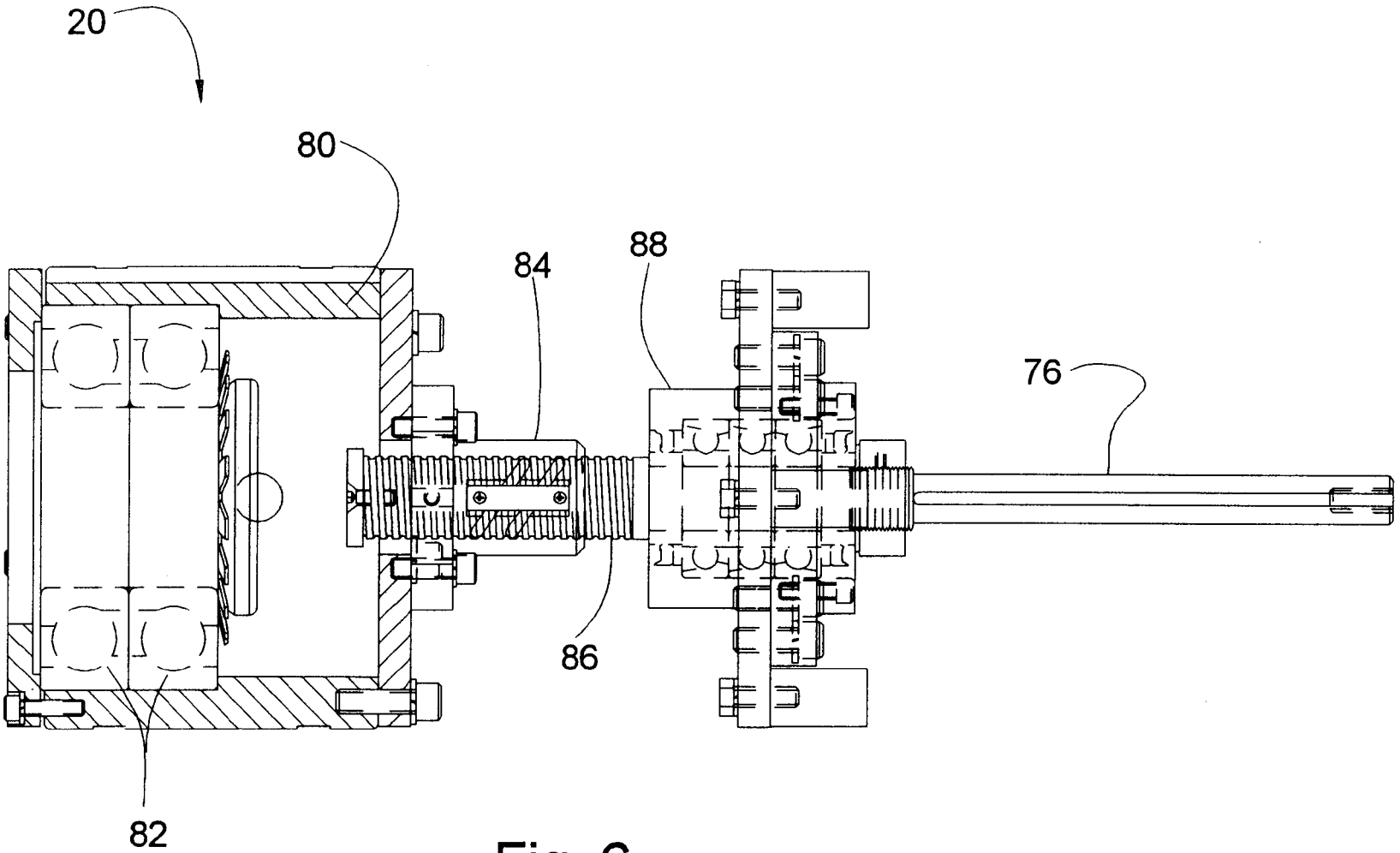
Fig. 6 PRIOR ART
FIG. 6 is an enlargement of a portion of FIG. 5.

The positioning mechanism is shown in detail in FIG. 6. A cage 80 is slidably supported within the housing 74 and is secured against rotation with respect thereto. Bearings 82 are mounted within the cage 80 and rotatably support the end of the drive shaft 30 remote from the driven grinding member support plate 42. The bearings 82 preferably comprise angular contact ball bearings, however, other types of bearings may be utilized in the practice of the invention, if desired.

Figure 7:
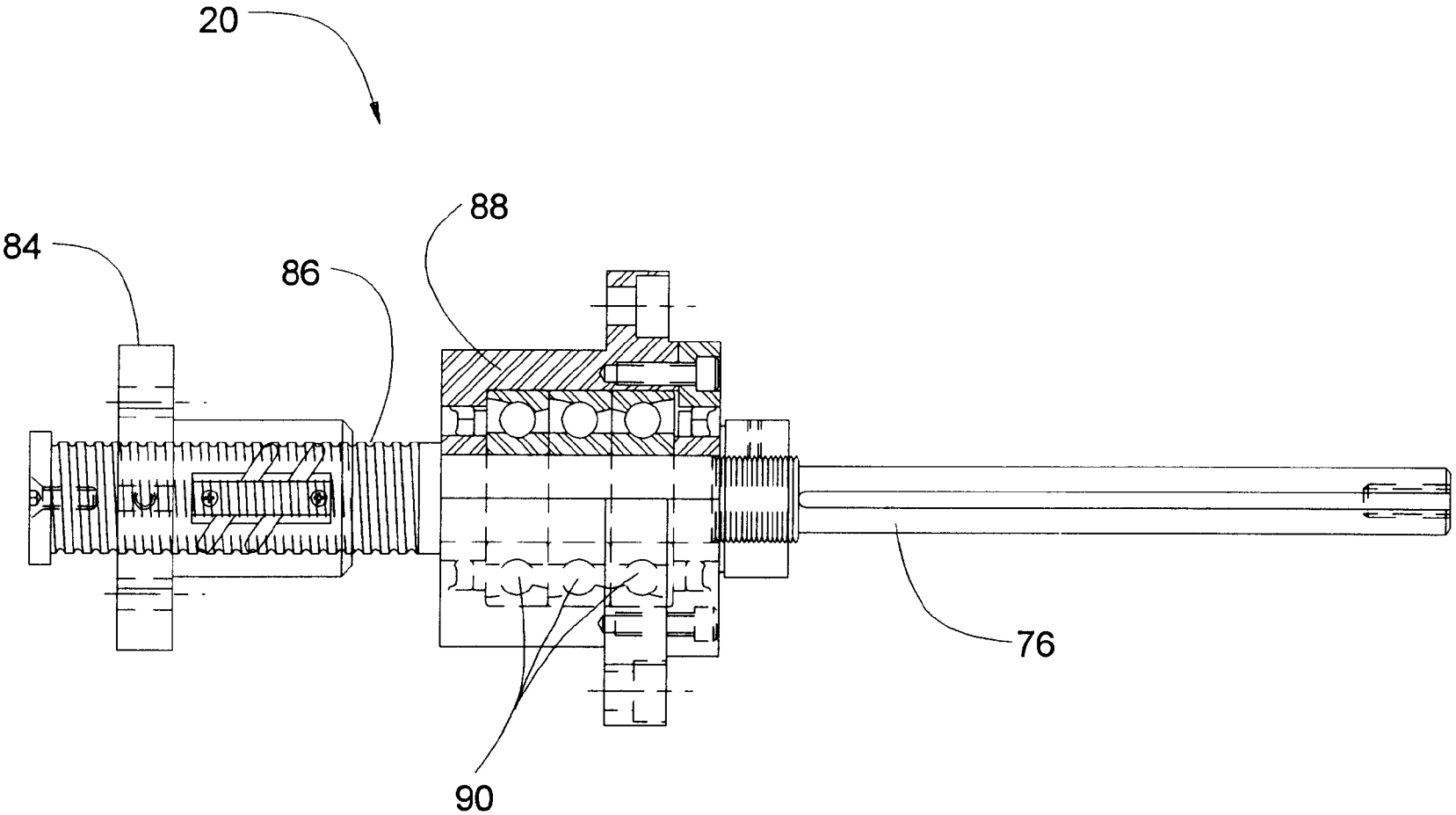
Fig. 7 PRIOR ART
FIG. 7 is an enlargement of a portion of FIG. 6.

A ball nut 84 is secured to the cage 80 and is operatively engaged with a ball screw 86. The ball screw 86 is rotatably supported in a housing 88 by a plurality of bearings 90. As is illustrated in FIGS. 5, 6, and 7, the housing 88 is secured within the housing 74. The positioning input shaft 76 is secured to the ball screw 86 to effect rotation thereof relative to the ball nut 84.

As will be appreciated by those skilled in the art, when the positioning input shaft 76 is rotated, the ball screw 86 rotates therewith. Rotation of the ball screw 86 results in longitudinal movement of the ball nut 84. Longitudinal movement of the ball nut 84 changes the longitudinal positioning of the cage 80 relative to the housing 74. Longitudinal movement of the cage 80 operates through the bearings 82 to effect longitudinal movement of the drive shaft 30 which in turn causes longitudinal movement of the driven grinding member support plate 42. Since the driven grinding member is supported on the plate 42, it will be understood that rotational input of the positioning input shaft 76 results in a change in the positioning of the driven grinding member 40 relative to the fixed grinding member 50.

Figure 8:
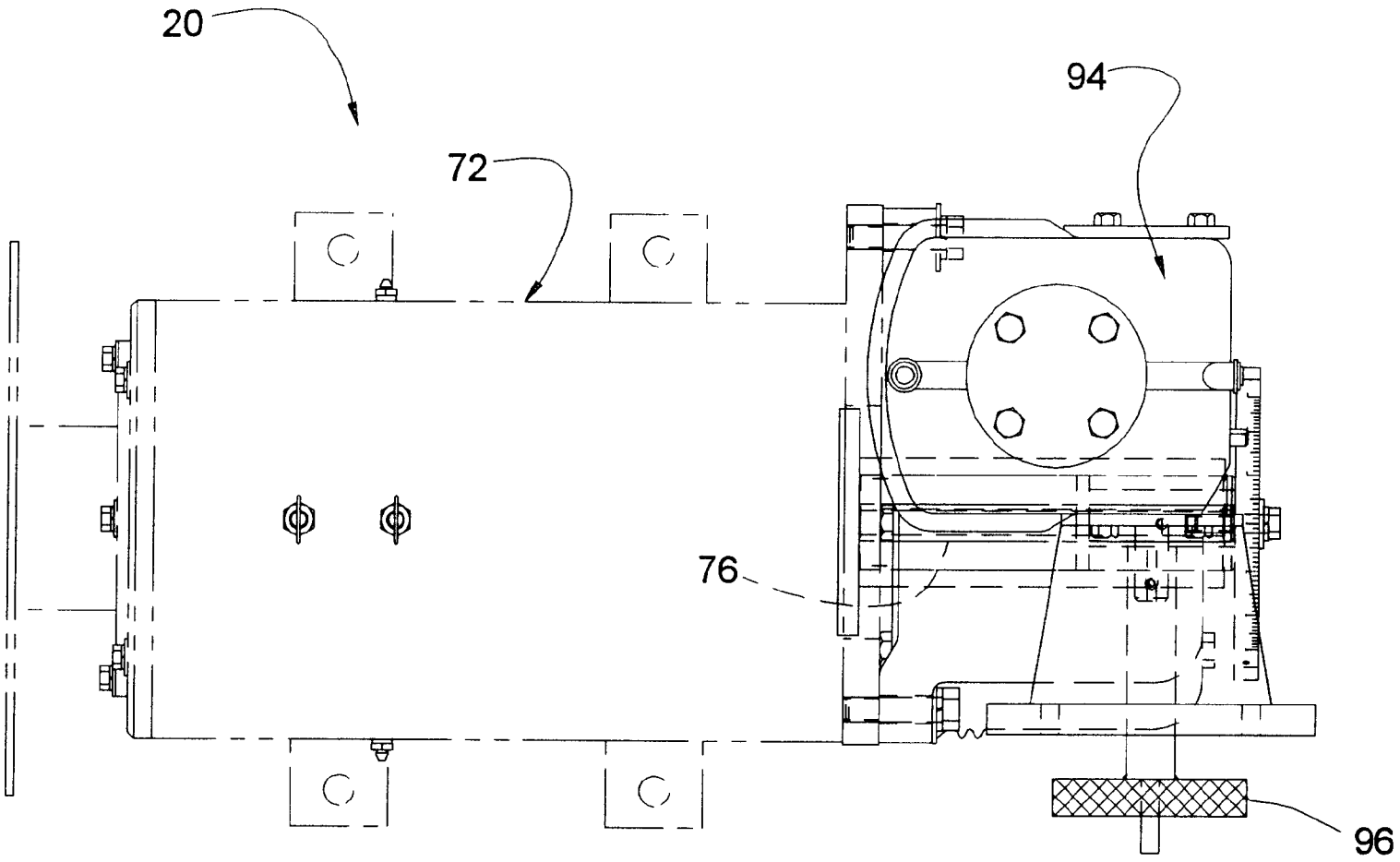
Fig. 8 PRIOR ART
FIG. 8 is a partial top view of the apparatus of FIG. 1 illustrating a manual driven grinding member positioning apparatus useful in conjunction therewith.
Figure 9:
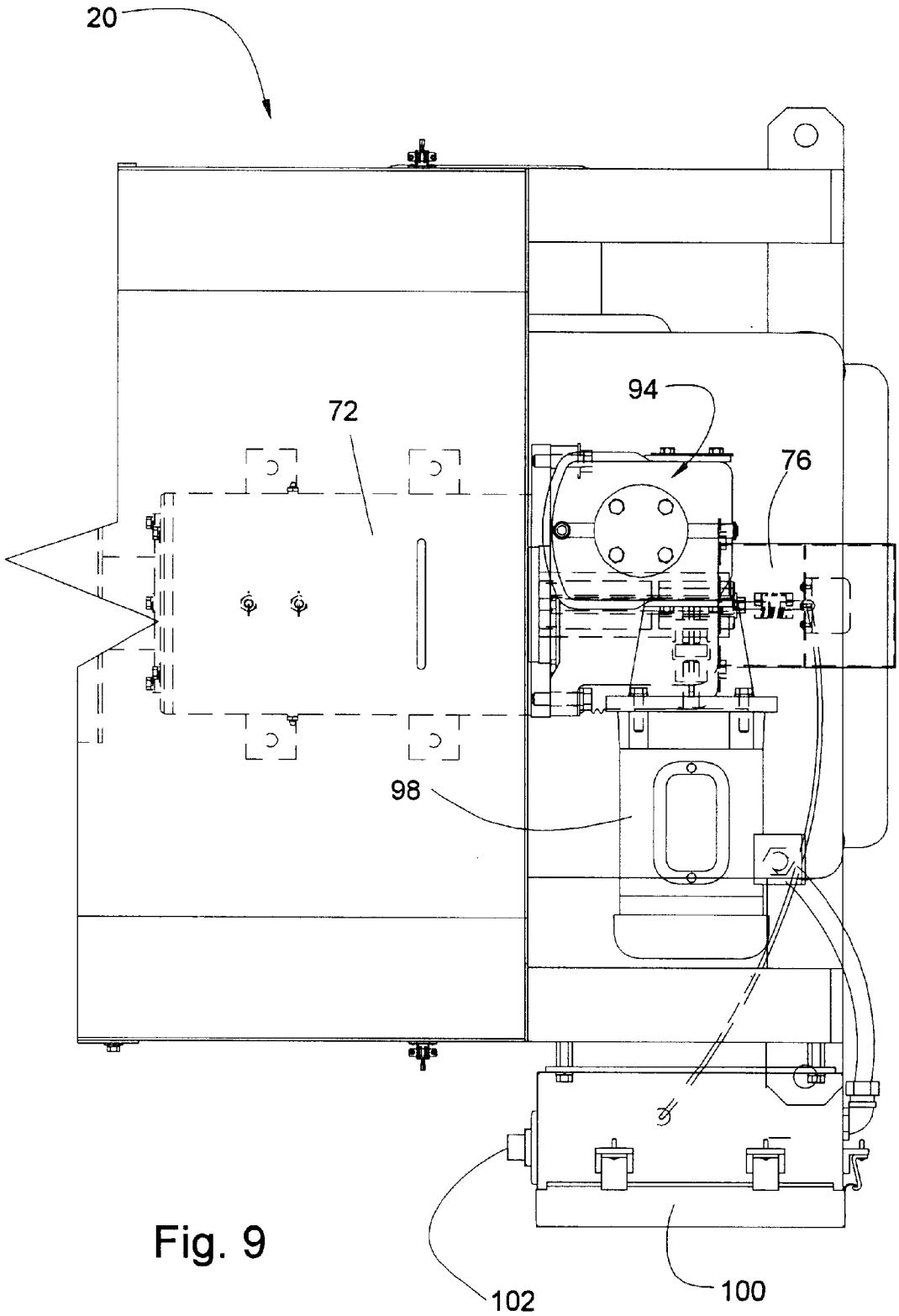
FIG. 9 is a top view of a portion of FIG. 1 illustrating an electrically operated driven grinding member positioning apparatus useful in conjunction therewith.
Figure 10:
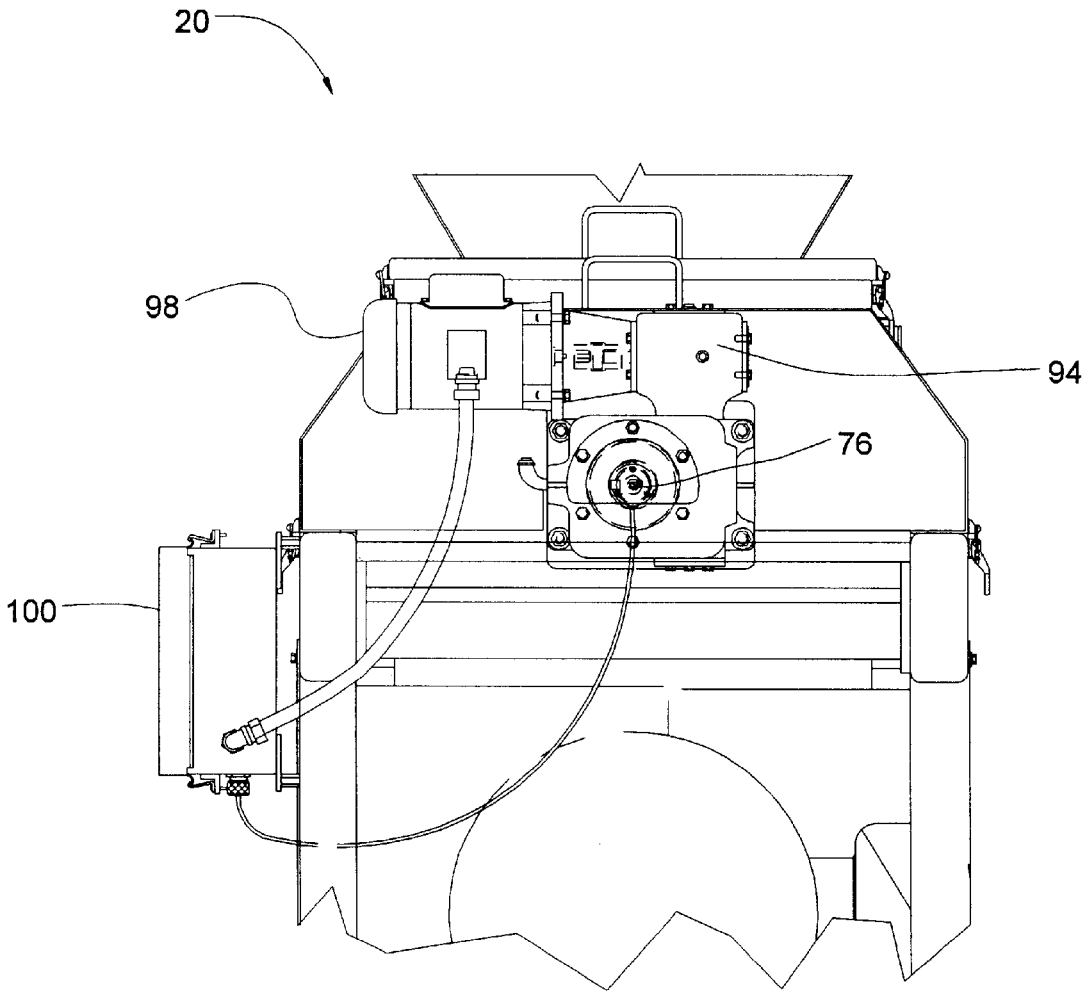
FIG. 10 is an end view of the apparatus of FIG. 9.

Referring to FIGS. 8, 9 and 10, the positioning input shaft 76 is adapted for either manual or electrical actuation. The positioning input shaft 76 extends through a worm gear speed reducer 94 which is secured to one end of the housing 74. The worm gear speed reducer 94 may be actuated manually by means of a thumbwheel 96. In such instances the positioning of the driven grinding member 40 relative to the fixed grinding member 50 is measured manually utilizing feeler gauges or the like.

Figure 11:
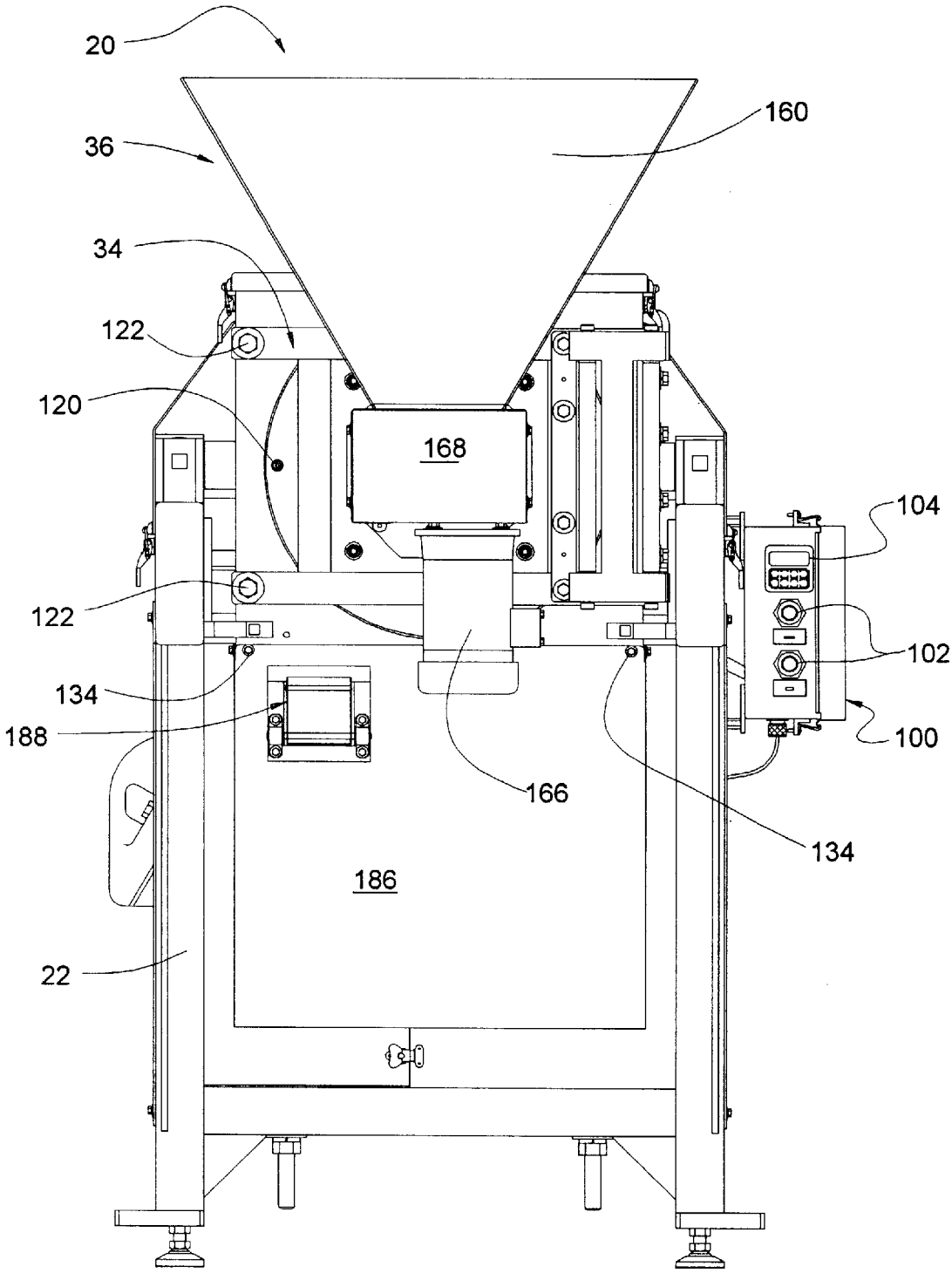
FIG. 11 is a front view of the grinding apparatus for foodstuffs of FIG. 1.

As is best shown in FIGS. 9 and 10, the worm gear speed reducer 94 may be actuated by an electric motor 98 in lieu of the thumbwheel 96. Operation of the motor 98 is regulated by conventional control circuitry contained within a housing 100. Referring to FIG. 11, the control circuitry may include control buttons 102 and a register 104 which indicates the positioning of the driven grinding member relative to the fixed grinding member.

Referring again to FIG. 3, the grinding chamber 28 comprises a housing 108 which is pivotally supported on trunnions 110. The door 34 is supported on the housing 108 by a double hinge mechanism 112 including a bracket 114 secured to the housing 108, a pivoting bracket 116, and a bracket 118 secured to the door 34. The use of the double hinge mechanism 112 is advantageous in that it allows the door to be swung to a fully open position to facilitate cleaning, etc. of the interior of the grinding chamber 28, and in that allows the door 34 to be positioned parallel to the housing 108 prior to being secured thereto.

During operation of the grinding apparatus for foodstuffs 20, the fixed grinding member 50 must be very precisely located relative to the driven grinding member 40. As will be appreciated by those skilled in the art, the fixed grinding member 50 is rigidly secured to the door 34 by means of the fasteners 54. When the door 34 is in the closed position as illustrated in FIG. 3, the door 34 is located relative to the housing 108 by a guide pin 120 and is rigidly secured to the housing 108 by a plurality of bolts 122. The guide pin 120 and the bolts 122 locate and secure the door 34 relative to the housing 108. Since the fixed grinding member 50 is rigidly secured to the door 34 by means of the fasteners 54, the fixed grinding member 50 is therefore rigidly secured in the housing 108.

The construction of the door 34 and the apparatus for locating and securing the door 34 relative to the housing 108 comprises an important feature of the invention. By this construction the precise positioning of the fixed grinding member 50 relative to the driven grinding member 40 is assured even after the door 34 has been opened and reclosed. This in turn dispenses with the necessity of repositioning the grinding members relative to one another whenever access to the interior of the grinding chamber is required, as has characterized previous foodstuff grinding apparatus.

Referring to FIG. 1, the trunnions 110 are pivotally supported in trunnion blocks 124 which are in turn supported on plates 126 comprising part of the frame 22. Each plate 126 has a block 128 extending upwardly therefrom which threadedly receives an adjustment screw 130. The adjustment screws 130 position the trunnion blocks 124 and the trunnion 110 contained therein relative to plate 126, after which the trunnion blocks 124 and the trunnion 110 are secured in place by threaded fasteners 132 which threadedly engage the trunnion blocks 124. It will therefore be understood that by actuation of the adjustment screws 130, the housing 108 of the grinding chamber 28 may be properly positioned about a vertically disposed axis.

Figure 12:
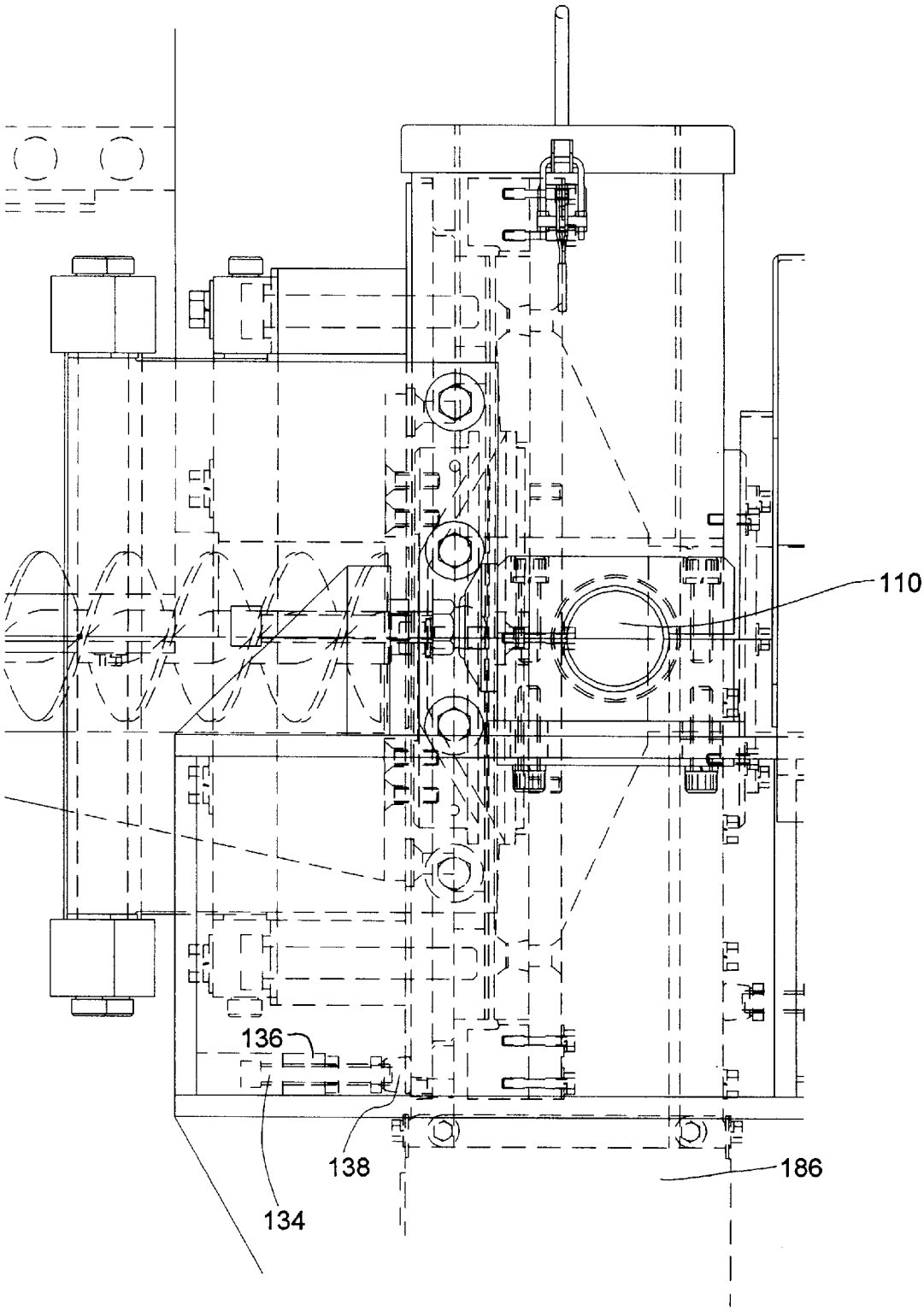
FIG. 12 is an illustration of the fixed grinding member positioning mechanism of the apparatus of FIG. 1.

As is shown in FIGS. 11 and 12, adjustment screws 134 are threadedly engaged with blocks 136 mounted on and comprising part of the frame 22. The adjustment screws 134 engage the housing 108 at 138. Upon actuation, the adjustment screws 134 pivot the housing 108 relative to the frame 22 about a horizontal axis extending through the trunnions 110. It will therefore be understood that by means of the adjustment screws 130 and 134 the housing 108 is positionable to precisely align the fixed grinding member 50 relative to the driven grinding member 40. Since the fixed grinding member 50 is rigidly secured to the door 34, and since the door 34 is precisely located relative to the housing 108 by means of the guide pins 120 and the bolts 122, the precise positioning of the fixed grinding member 50 relative to the grinding member 40 is assured even though the door 34 is repeatedly opened and closed.

Figure 13:
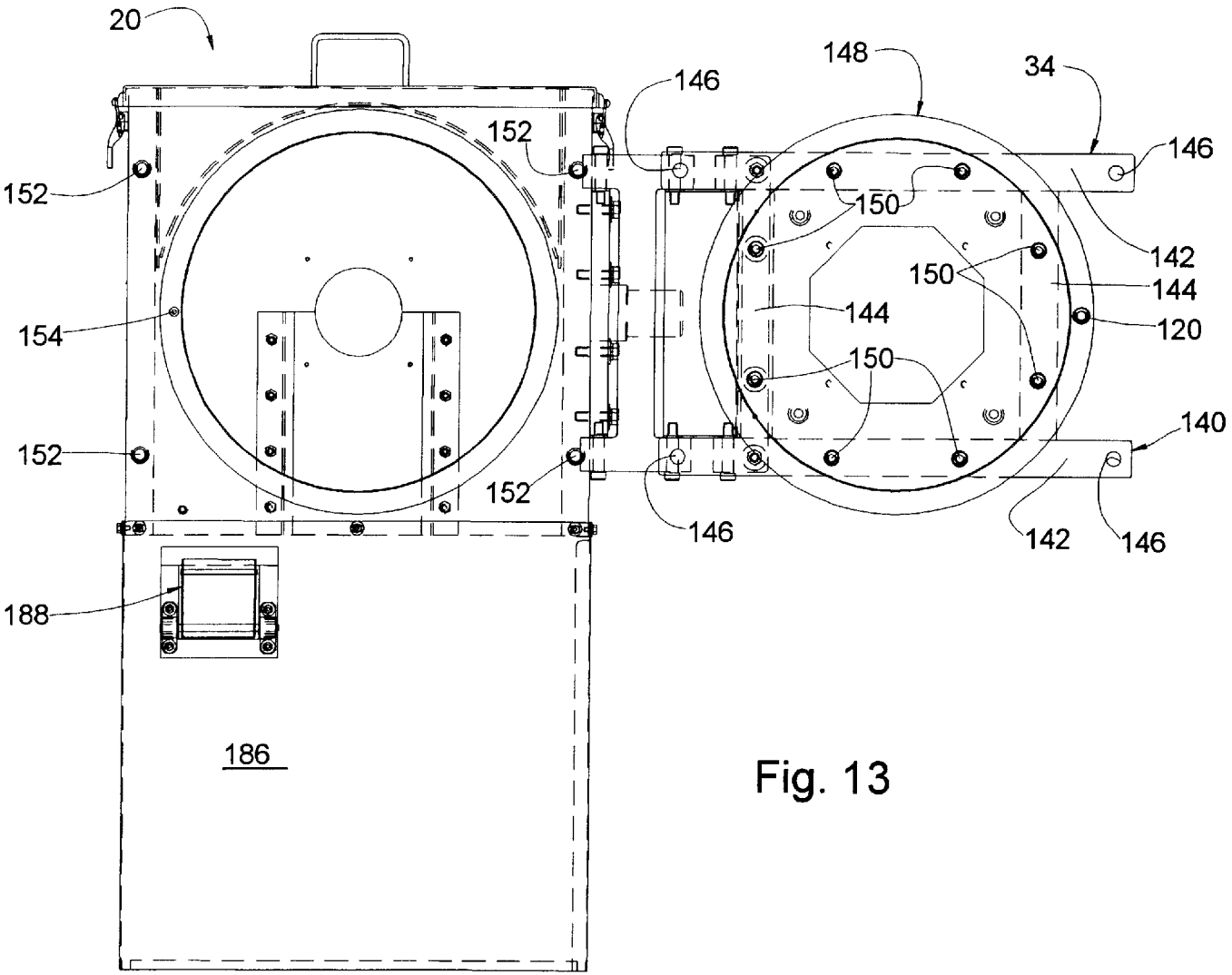
FIG. 13 is an illustration similar to FIG. 12 further illustrating certain structural details of the apparatus of FIG. 1.
Figure 14:
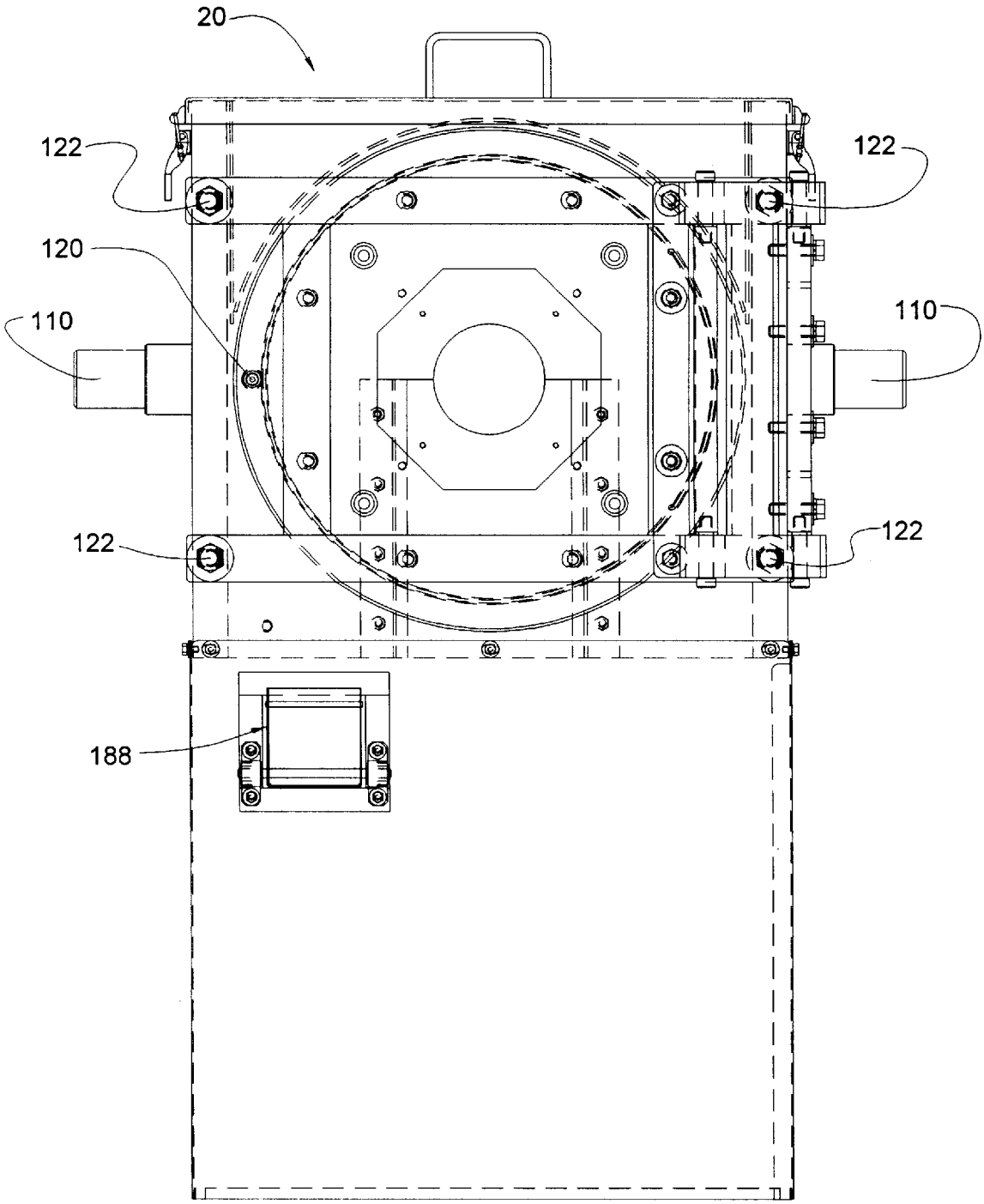
FIG. 14 is an illustration similar in some respects to FIGS. 11 and 13 showing the door of the grinding apparatus in the closed position.

The construction of the door 34 is further illustrated in FIGS. 13 and 14. The door 34 includes a frame 140 including horizontally disposed bars 142 and vertically disposed bars 144. Apertures 146 extend through the bars 142 for receiving the bolts 122 therethrough. A circular member 148 is mounted on the frame 140 and functions to close the interior of the grinding chamber 28. The circular member 148 is secured on the frame 140 by a plurality of fasteners 150. The guide pin 120 is mounted on the circular member 148. The housing 108 has a plurality of threaded apertures 152 which receive the bolts 122 extending the apertures 146 when the door 34 is in the closed position. The housing 108 further includes an aperture 154 for receiving the guide pin 120 to precisely position the door 34 relative to the housing 108.

Figure 15:
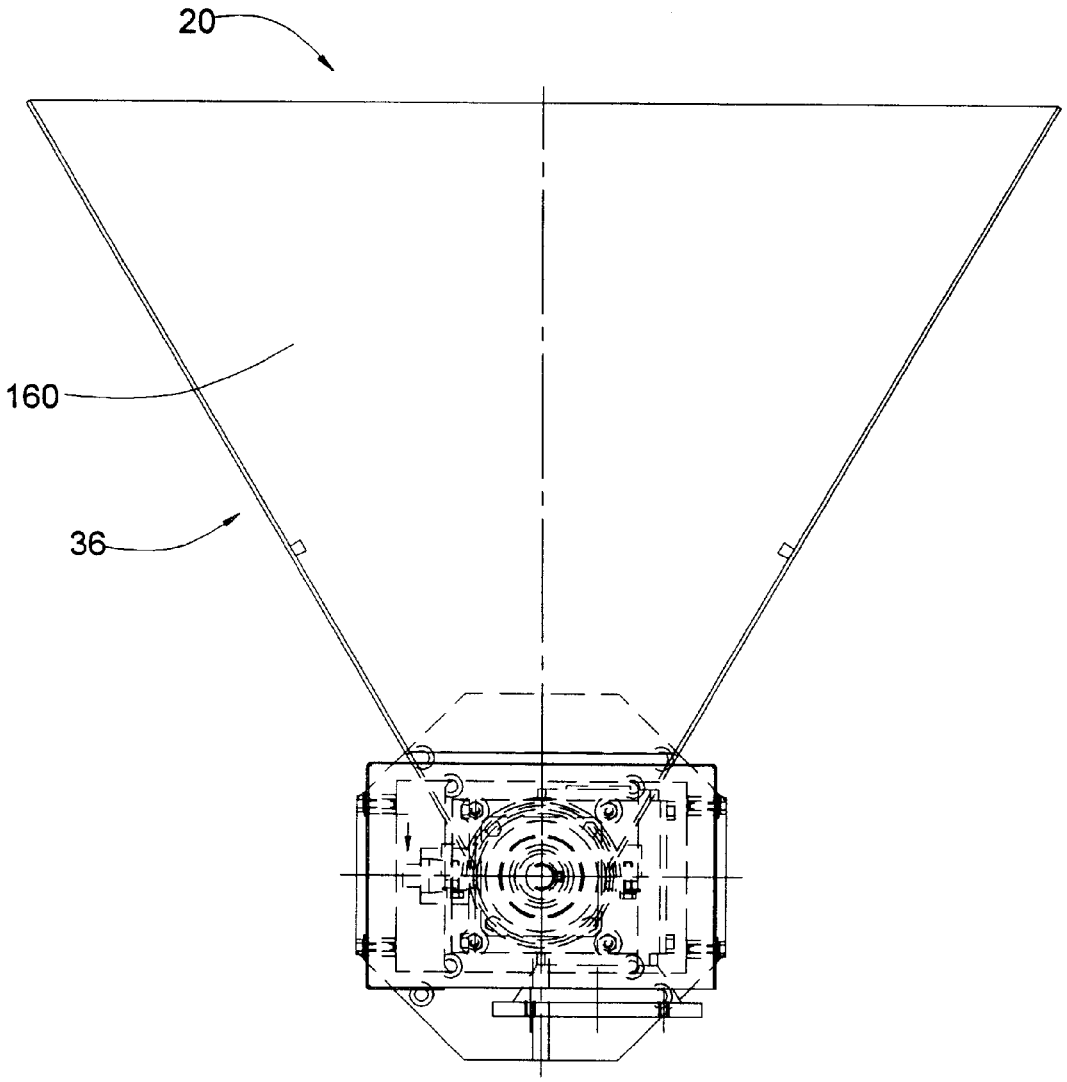
FIG. 15 is an end view of the input mechanism of the apparatus of FIG. 1.
Figure 16:
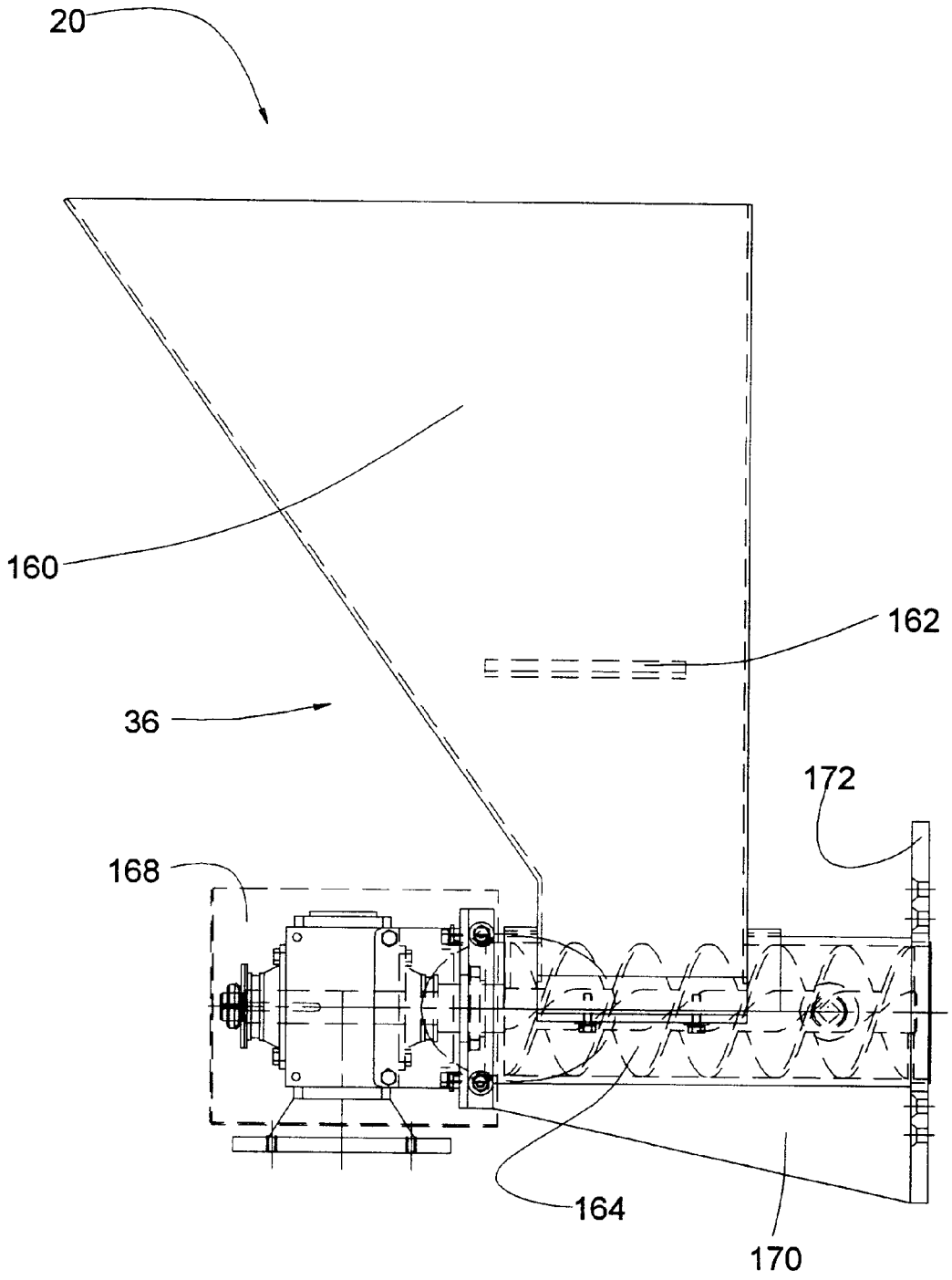
FIG. 16 is a side view of the input mechanism of the apparatus of FIG. 1.

Referring to FIGS. 1, 15, and 16, the input mechanism 36 of the grinding apparatus for foodstuffs 20 is shown in detail. A hopper 160 receives a quantity of foodstuffs to be ground. The hopper 160 may be provided with a magnetic filter 162 for preventing metal objects from entering the grinding chamber. The hopper 160 extends to and comprises the input to an auger 164. The auger 164 is driven by a motor 166 operating through a speed reducer 168. The auger 164 extends through a housing 170 which supports the hopper 160 and which extends to a vertically disposed plate 172. As is best shown in FIG. 3, the vertically disposed plate 172 of the housing 170 is secured to the door 34 by a plurality of fasteners 174.

The construction and operation of the grinding apparatus for foodstuffs 20 is further illustrated in FIG. 17. The driven grinding member 40 and the fixed grinding member 50 illustrated therein comprise metal grinding members and are characterized by relatively spaced apart inner vanes 180 and relatively closely spaced outer vanes 182. The auger 164 directs foodstuffs to be ground into the inner portion of the fixed grinding member 50. A distributing blade 184 secured on the driven grinding member 40 for rotation therewith distributes the received foodstuffs into engagement with the vanes 180 and 182 on the driven grinding member 40 and the fixed grinding member 50 whereby the foodstuffs are ground under the action of the motor 26 operating through the drive shaft 30. As is illustrated in FIGS. 1, 2, and 12, a discharge chute 186 extends downwardly from the grinding chamber 28 whereby ground foodstuffs are discharged from the grinding chamber 28 under the operation of gravity. Discharge is facilitated by grinding chamber clearing members mounted on the driven grinding member for rotation therewith.

As is shown in FIGS. 2, 11, 13, 14, and 17, the discharge chute 186 includes an access door 188. As is best shown in FIG. 2, the access door 188 takes the form of a cup which in the normal orientation is closed on the outside and extends into the path of material falling downwardly in the discharge chute 186. The access door 188 is manually pivotable about a horizontal access whereupon the material received therein is accessible from outside the apparatus 20. This facilitates monitoring of the operation of the apparatus 20 without requiring the insertion of hands and fingers into the device, as has been the case in prior art food grinding mechanisms.

As is also shown in FIG. 2, the motor 26 is mounted on a plate 190 which is in turn supported on threaded rods 192. The rods 192 engage nuts 194 which position the motor 26 relative to the frame 22. This construction is highly advantageous in that it allows the use of motors 26 of various sizes and/or the use of drive pulleys 68 of various sizes in order to meet the requirements of various applications of the invention without necessitating the changing of the toothed belt 70.

Although preferred embodiments of the invention have been illustrated in the accompanying drawings and described in the foregoing detailed description, it will be understood that the invention is not limited to the embodiments disclosed, but is capable of numerous rearrangements, modifications, and substitutions of parts and elements without departing from the spirit of the invention.

What is claimed is:

1. An apparatus for grinding foodstuffs comprising:

a grinding chamber including a housing;

a fixed grinding member fixedly mounted within the housing;

a driven grinding member mounted within the housing for rotation relative to the fixed grinding member to grind foodstuffs therebetween;

apparatus for selectively varying the spacing between the driven grinding member and the fixed grinding member; and apparatus for selectively pivoting the housing about mutually perpendicular axes and thereby varying the parallelism between the fixed grinding member secured to the housing and the driven grinding member.

2. The grinding apparatus for foodstuffs according to claim 1 further characterized by:

a drive shaft having the driven grinding member mounted at one end thereof for rotating the driven grinding member relative to the fixed driving member; and a mechanism for selectively varying the positioning ofthe drive shaft and the driven grinding member mounted thereon relative to the fixed grinding member.

3. The apparatus for grinding foodstuffs according to claim 1 further characterized by:

a frame;

trunions projecting from opposite sides of the housing;

trunion receiving members mounted on the frame for supporting the housing for pivotal movement about a first axis; and at least one positioning member extending between the frame and the housing for selectively pivoting the housing relative to the frame about the first axis.

4. The apparatus for grinding foodstuffs according to claim 3 further characterized by:

means for selectively varying the positioning of the trunion receiving members on the frame and thereby pivoting the housing about a second axis.

5. The apparatus for grinding foodstuffs according to claim 1 wherein the housing includes a door, wherein the fixed grinding member is mounted on the door of the housing to facilitate opening of the grinding chamber, and means for returning the door and the fixed grinding member to a predetermined positional relationship relative to the housing after the door has been opened.

6. The apparatus for grinding foodstuffs according to claim 5 wherein the door positioning means includes a guide pin and a guide pin receiving aperture mounted on the housing and the door for positioning the door relative to the housing as the door is closed and a plurality of threaded fasteners for securing the door in the position determined by the guide pin and the guide pin aperture.

7. An apparatus for grinding foodstuffs comprising:

a housing defining a grinding chamber;

a fixed grinding member mounted secured within the housing;

a driven grinding member mounted within the housing for rotation relative to the fixed grinding member to grind foodstuffs therebetween;

apparatus for selectively varying the positioning of the driven grinding member relative to the fixed grinding member and thereby varying the spacing between the driven grinding member and the fixed grinding member; and apparatus for selectively pivoting the housing about mutually perpendicular axes and thereby varying the parallelism between the fixed grinding member secured to the housing and the driven grinding member.

8. The grinding apparatus for foodstuffs according to claim 7 further characterized by:

a drive shaft having the driven grinding member mounted at one end thereof for rotating the driven grinding member relative to the fixed driving member; and a mechanism mounted at the opposite end of the drive shaft from the driven grinding member for selectively varying the positioning of the drive shaft and the driven grinding member mounted thereon relative to the fixed grinding member.

9. The apparatus for grinding foodstuffs according to claim 7 further characterized by:

a frame;

trunions projecting from the housing;

trunion receiving members mounted on the frame for supporting the housing for pivotal movement about a first axis; and at least one positioning member extending between the frame and the housing for selectively pivoting the housing relative to the frame about the first axis.

10. The apparatus for grinding foodstuffs according to claim 9 further characterized by:

apparatus for selectively varying the positioning of the trunion receiving members on the frame and thereby pivoting the housing about a second axis.

11. The apparatus for grinding foodstuffs according to claim 7 wherein the housing includes a door, wherein the fixed grinding member is secured to the door of the housing to facilitate opening of the grinding chamber, and apparatus for returning the door and the fixed grinding member to a predetermined positional relationship relative to the housing after the door has been opened.

12. The apparatus for grinding foodstuffs according to claim 11 wherein the door positioning apparatus includes a guide pin and a guide pin receiving aperture mounted on the housing and the door for positioning the door relative to the housing as the door is closed and a plurality of threaded fasteners for securing the door in the position determined by the guide pin and the guide pin aperture.

* * * * *